United States Patent [19]

Sloan et al.

[11] Patent Number: 4,807,373

[45] Date of Patent: Feb. 28, 1989

[54] LOOP CIRCUIT DREDGING APPARATUS

[75] Inventors: Owen K. Sloan; Albert H. Sloan, both of Ft. Lauderdale, Fla.

[73] Assignee: Sloan Pump Company, Inc., Fort Lauderdale, Fla.

[21] Appl. No.: 47,220

[22] Filed: May 8, 1987

[51] Int. Cl.[4] ..... E02F 3/88

[52] U.S. Cl. ..... 37/63; 37/58; 210/170; 210/237; 210/241; 210/416.1

[58] Field of Search ..... 37/63, 62, 61, 58, 195; 210/237, 241, 258, 416.1, 170

[56] References Cited

U.S. PATENT DOCUMENTS

| | | | |
|---|---|---|---|
| 1,611,478 | 12/1926 | Massey | 37/58 X |
| 3,631,997 | 1/1972 | De Koning | 37/58 X |
| 3,975,842 | 8/1976 | Andreae | 37/63 X |
| 3,999,566 | 12/1976 | Iwata et al. | 37/58 X |
| 4,053,181 | 10/1977 | Saito | 37/58 X |
| 4,352,251 | 10/1982 | Sloan | 37/58 |
| 4,479,741 | 10/1984 | Berti et al. | 37/63 X |

FOREIGN PATENT DOCUMENTS

| | | | |
|---|---|---|---|
| 6711834 | 3/1969 | Netherlands | 37/58 |
| 6711836 | 3/1969 | Netherlands | 37/58 |
| 137397 | 8/1973 | Netherlands | 37/58 |
| 796327 | 1/1981 | U.S.S.R. | 37/58 |
| 1182124 | 9/1985 | U.S.S.R. | 37/58 |
| 1374911 | 11/1974 | United Kingdom | 37/61 |

*Primary Examiner*—Clifford D. Crowder
*Attorney, Agent, or Firm*—James E. Nilles

[57] ABSTRACT

A loop circuit method and apparatus for dredging a first area water and in which the water being used to transport the solid material (the dredging water) is continuously routed around in a loop and used repeatedly to convey the solid material from the first area to a second, solids collecting area. The loop circuit may be either quasi-closed or completely closed depending on where the returning dredge water is discharged at the first area. An improved dredge head which may be operated by a diver and in which the returning dredge water is discharged adjacent the nozzle and acts to stir up the material in that location. Alternatively, the returning dredge water can be discharged directly in the nozzle of the dredge head and acts to help convey the material picked up by the nozzle, and this constitutes a completely closed circuit. The second area of solid collecting area may include a dump body into which the mixture is dumped and from which the returning dredge water is extracted via a filter, and then returned to the first area.

7 Claims, 4 Drawing Sheets

LOOP CIRCUIT DREDGING APPARATUS

BACKGROUND OF THE INVENTION

Related Art

Some of the apparatus of the present invention is in part in the nature of an improvement over that shown in U.S. Pat. No. 4,352,251 which issued Oct. 5, 1982 and is entitled "Hand Operated Suction Dredge Head and Hydraulic Submersible Pump Assembly".

SUMMARY OF THE INVENTION

The present invention pertains to a dredging apparatus for continually using essentially the same water in a loop circuit for pumping a mixture of solids and water from a dredging area to a solids collecting area.

More specifically, the present, invention provides a loop circuit dredging apparatus for continuously dredging a mixture of solids and water from a first body of water dredging area, pumping the mixture from the dredging area and allowing the solids to settle out from the dredge water at a second, separate body of water, returning the relatively clear dredge water to the first body of water, and then reusing the dredge water to again convey more solids from the first dredging area to said second body of water, thereby continually reusing and pumping the dredged water in a loop circuit to convey solids from the first dredging area to the second solids collecting area. A more limited aspects includes using a dredge head having a suction nozzle for picking up the mixture at the first area of water and pumping it to the second solids collecting area, and returning said relatively clear dredge water from the second area to the dredge head and discharging it adjacent said nozzle to thereby stir up the mixture adjacent said nozzle to facilitate picking up said mixture by said nozzle.

A further more specific aspect includes use of a dump body as the second solids collecting area body of water and the use of a filter tank for withdrawing the dredge water from the filter tank for then being pumped back to the first area.

Another more limited aspect of the invention provides apparatus for continuously dredging a mixture of solids and water from the first body of water and pumping it to one portion of a remote second body of water. The solids settle out of the mixture and meanwhile the water is pumped from another portion of the second body of water and adjacent its surface back to the first body of water where it is discharged well below the surface of the first body of water to thereby prevent foaming in the first body of water. This apparatus finds particular utility where the ecological requirements of the area permit the dumping of the solid material such as sand in the area, but restrict or prevent the deposit of an excess amount of water in the area. A more specific aspect of the apparatus includes the use of a hand-held dredge head having a suction nozzle for dredging the mixture and also having a hydraulically driven pump for pumping the mixture to the second body of water where the solids settle out. Furthermore, a hydraulic pump is floatingly located adjacent the surface of the second body of water for pumping relatively clear water from adjacent the surface of the second body of water and back to the first body of water where it is discharged below the surface of the first body of water.

Still, a more limited aspect of the invention relates to apparatus of the above-type in which the returned water is routed through the dredge head which is working in the first body of water and the returned water is discharged under pressure adjacent the nozzle of the dredge head to thereby stir up the solids and water adjacent the nozzle to facilitate picking the mixture up by the nozzle.

The invention also provides a hand-operated dredge head for use by a diver and which head has a suction nozzle at its lower inlet end and also has an upper end for the entry of water into the dredge head; a tubular discharge branch extends from the nozzle and has a discharge end for connection to a suction pipe that conveys the material away from the dredge head and to a remote second body of water; a hand-operated valve permits the diver to adjust the position and vary the amount of water introduced into the nozzle to thereby vary the suction at the nozzle; and means are provided on the nozzle for receiving returned water from the remote body of water and discharging the returned water under pressure adjacent the inlet end of the dredge head to thereby stir up the material and water adjacent the inlet end to facilitate pick up by the nozzle. A more limited aspect of the invention relates to the said means being a sleeve which is concentrically mounted around the tubular nozzle and which provides an annular space into which the returned water is directed under pressure and from which space it is discharged adjacent the lower inlet end of the dredge head to stir up the material in that area. A more specific aspect of this invention also includes a deflector ring located on the dredge head adjacent the nozzle and for deflecting the returned water that issues under pressure from the annular space within the sleeve, thereby preventing the returned water from simply re-entering the inlet nozzle.

Another aspect of the invention relates to an improved dredge head that provides a completely closed loop for the dredging method.

These and other objects and advantages of the present invention will appear hereinafter as this disclosure progresses, reference being had to the accompanying drawings.

DESCRIPTION OF A PREFERRED EMBODIMENT

The present invention provides apparatus for carrying out that dredging from a first dredging area where it is necessary or desirable to return the relatively clean dredge water from a second solids collecting pond, filter pit, sand pit, dump body or other spoil area to which the mixture of solids and water has been pumped. In other words, for ecological or other reasons it is essential to not flood or pump excessive water into the second solids collecting spoil area.

The present invention permits the mixture of solids and water to be pumped to the second solids collecting area where the solids settle out from the mixture.

Figure 1:
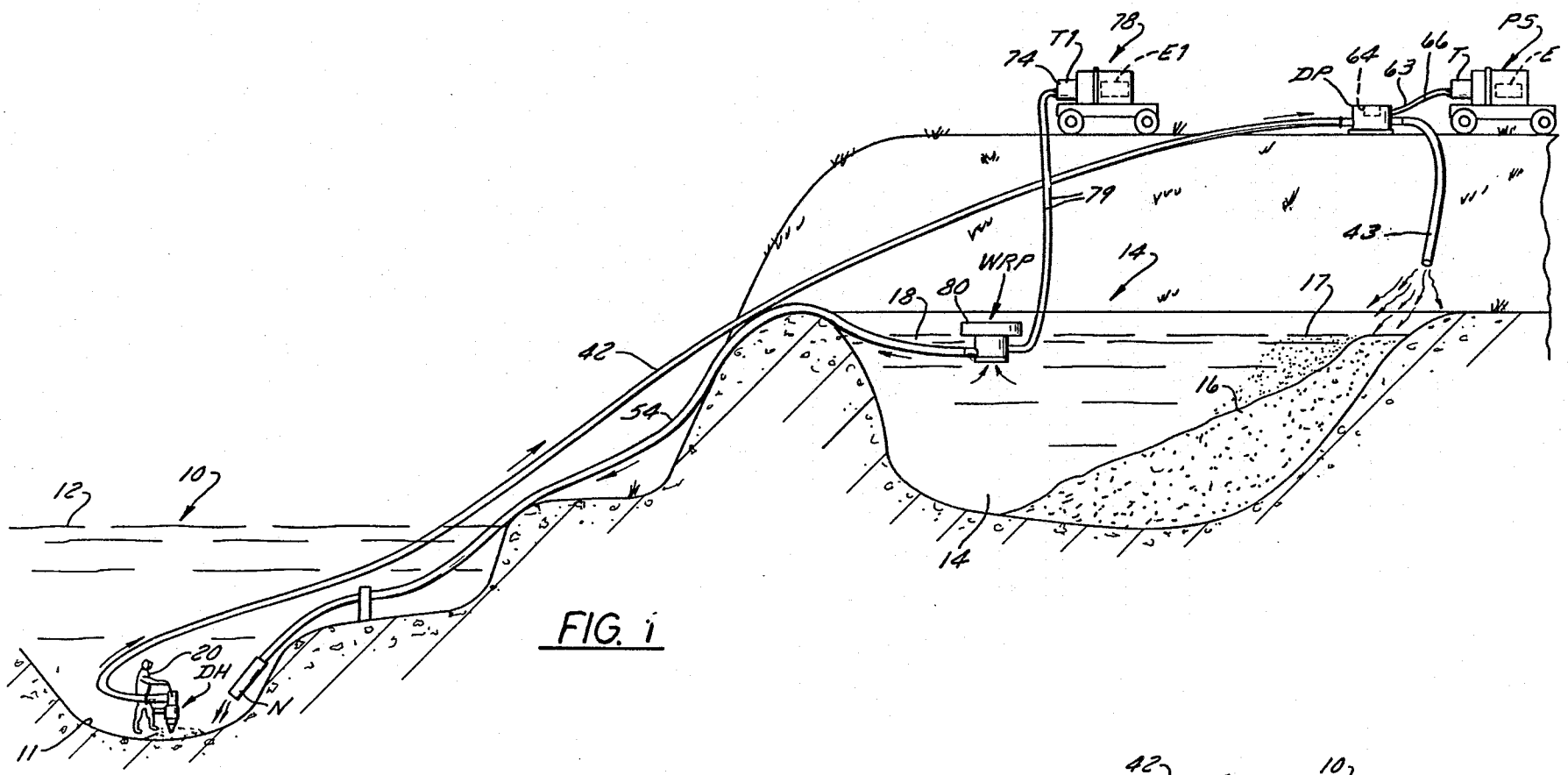
FIG. 1 is a generally schematic, vertical cross-sectional view through an area of the ground and showing a first body of water in which dredging is being accomplished and also showing a second body of water or spoil area to which the dredged material is delivered; the returned dredging water is discharged adjacent the dredge head.

As shown in FIG. 1, while the pumping of the mixture and settling of the solids is taking place, the relatively clean dredge water is returned for reuse in conveying additional solids. That is, the relatively clean water which has risen to the top of the second body of water is pumped off from the second body adjacent its surface, and this water is then returned to the first body of water where the dredging takes place. The returned water is conducted to well below the surface of the body of water being dredged so that foaming, surface turgidity or other turbulence is avoided which, among other things, makes it difficult for good visibility of the diver. The returned water can simply be returned and dumped into the first body of water or, alternatively, if the need arises, it can be routed to adjacent the dredge head (FIG. 1) via a separate nozzle N or through a sleeve 50 (FIG. 3) around the hand-held dredge which is being operated by the diver. The returned water is then discharged under pressure adjacent the inlet end of the dredge head where it acts to stir up the water and sand in the inlet area of the head to thereby facilitate it being picked up by the dredge head. If necessary, a deflector ring 60 (FIG. 3) can be used around the dredge head adjacent the nozzle so that the returned water is deflected away from the immediate area of the inlet end of the nozzle so that it will not be simply picked up again by the inlet nozzle before it performs its stirring up function.

Referring more specifically to the drawings (FIGS. 1 and 6), the first dredging area, i.e., the body of water 10 which is being dredged has a bottom indicated generally at 11 in which the dredging takes place and which is located well below the surface 12 of the first body of water.

In the FIG. 1 embodiment, a second body of water 14 may be located a considerable distance from the first body of water and at such a location that excessive water cannot be accumulated in that remote area. As an example, the solid material 16, such as sand, and which has been dredged from the first body of water 10 is located generally at one portion 17 of the second body of water 14, for example, as shown to the right in FIG. 1. Thus, the solid material 16 collects at portion 17 of the second body of water while another remote portion 18 of the body of water 14 is of relatively clean or clear consistency.

Referring again to the first body of water 10 being dredged, a hand-held dredge head DH is held by the operator 20.

One form of dredge head DH of the present invention is in the nature of an improvement over the dredge head shown in the said U.S. Pat. No. 4,352,251, the latter of which has proved to be particularly successful in commercial operation. If a detailed description of the dredge head is deemed to be either necessary or desirable, reference may be had to the said patent. For the purposes of the present description (as shown clearly in FIGS. 3, 4, 7 and 8), the dredge head is preferably made of an aluminum alloy and is light-weight and easily portable by the operator, it is compact and relatively small and has all of its parts within easy reach of the operator. The dredge head includes the elongated tubular suction nozzle 30 having a lower end to which is welded or otherwise secured a shield or grill 31 fabricated from aluminum alloy rods. This grill prevents relatively large material such as rocks, cans or other foreign material from entering the dredge head. The upper or opposite end of the tubular suction nozzle is relatively open except for the rods 12 welded thereacross which prevent inadvertent entry of material therein. Adjacent the upper end 32 of the suction nozzle 30 is a circular plate, butterfly type valve 34, fixed to and oscillatably mounted on its shaft 35. A U-shaped operator's handle 37 is fixed to the shaft 35 by bolts 39 extending through the cup-shaped members 38 that in turn are welded to the handle. The valve is swingable to any one of a number of adjusted positions between a closed position where it prevents water from entering the upper end of the nozzle to a fully open position where water can freely enter the upper end of the nozzle due to the suction in the conduit 42.

The dredge head also includes a tubular discharge branch 44 which is welded to the tubular suction nozzle 30 intermediate the length of the latter and is thereby in fluid communication therewith. The rear or discharge end of the branch 44 is secured to the inlet end of the suction conduit 42 by means of a conventional swivel coupling 45. Coupling 45 provides a swivel connection between the dredge head and the suction conduit so the head can be rotated relative to the conduit by the operator to any suitable position.

Figure 2:
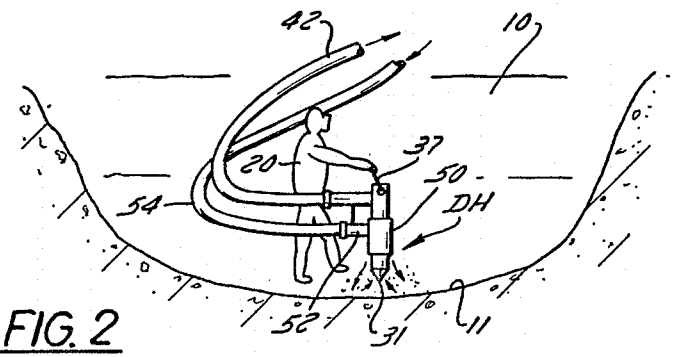
FIG. 2 is a fragmentary view of a portion of the arrangement shown in FIG. 1 and which shows an alternate form of discharging the returned water, that is, to the hand-held dredge head for discharge as a jet adjacent the nozzle pick-up, to form a quasi-closed loop system.

The improved dredge head provided by the present invention includes means for receiving returned dredge water (which is returned by means to be described later) from a second solids collecting area, such as the second body of water 14 shown in FIG. 1, and discharging it under pressure adjacent the lower inlet end of the nozzle, to thereby stir up the material and water adjacent the inlet end of the nozzle, as shown in FIG. 2. This water return means may take the form of a separate jet nozzle (not shown). Another water return means may take the form of a sleeve 50 (FIGS. 2, 3 and 4) which is concentrically mounted around the tubular nozzle 30 and has a laterally extending conduit 52 for receiving returned water from the remote body of water. Conduit 52 has a swivel joint connection 53 for connection with the returned water conduit 54. The upper end of the sleeve 50 is closed by being welded as at 55 (FIG. 3) to the dredge head 30. The sleeve and dredge head 30 form an annular space 57 or chamber therebetween. The cross-sectional area of the annular space 57 is equal to or greater than the cross-sectional area of conduit 52. The lower end of the sleeve is open for discharging water under pressure towards the lower end of the nozzle to thereby act to stir up the material and water in that area being dredged as above mentioned.

Figure 3:
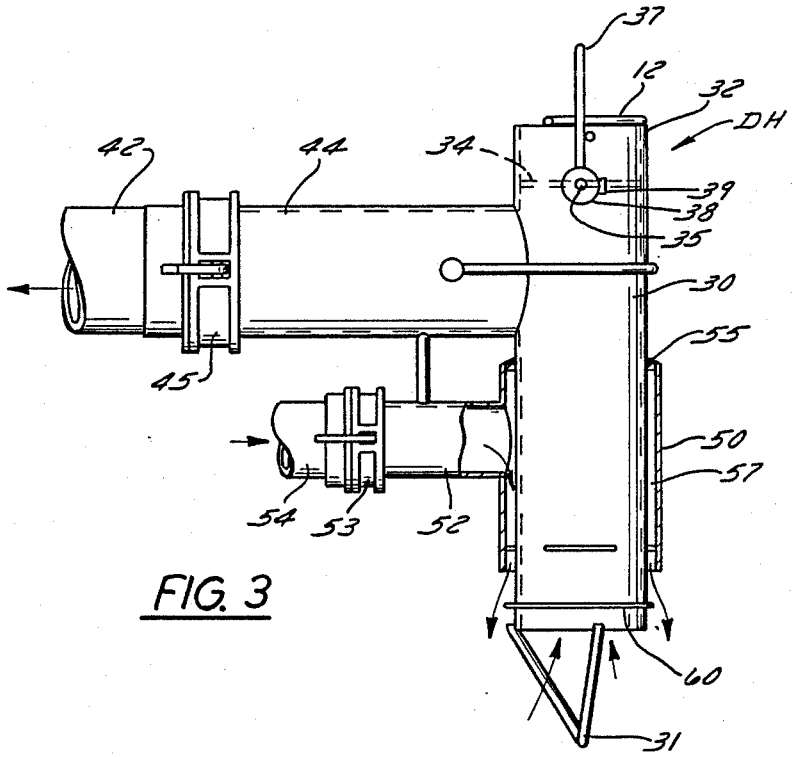
FIG. 3 is a side elevational view, partially in section, of the improved dredge head on an enlarged scale from the schematic showing of the head in FIG. 2.

However, it may be desirable to deflect the returned water somewhat away from the inlet end of the nozzle so that it is not simply again sucked up and pumped to the remote second body of water 14. For this purpose, a deflector means such as ring 60 is welded and located on the nozzle and adjacent the discharge end of the returned water sleeve. Ring 60 acts to deflect the water, as it is discharged from the sleeve, away from the nozzle, as indicated in FIG. 3.

It should be mentioned that if the nozzle is working in a mixture of "soupy" consistency, that is, of relatively fluid consistency, the nozzle itself may be buried in the mixture, and in this situation, it may not be necessary to use returned water to stir up the material. In that event, the returned water can be simply deposited in the area being dredged, but well below the surface 12 of that area, as indicated in FIG. 1.

The mixture of material being dredged is conveyed by the conduit 42 where it discharges at that end 43 of the conduit located at the said one portion 17, that is, off to one side of the second body of water 14, and as indicated at the right side of FIG. 1.

A dredge pump DP (FIG. 1) is provided for the dredge head and which has a dredge power source PS which can be located on the shore. The power source PS may take the form as shown and described in the U.S. Pat. No. 3,910,728 or 4,352,251 and which includes an internal combustion engine E that drives the positive displacement pressure fluid dredge pump DP that directs pressure fluid via flexible conduits 63 to and from a hydraulic motor 64 on the hydraulically operated dredge pump DP. Flexible conduit 66 returns the pressure fluid to the pressure fluid reservoir tank T of the power source PS. Thus, the hydraulic motor drives the motor 64 to induce (or suck) the mixture of water and solids through the conduit 42 and pump it through the discharge conduit 43 to the second body of water as shown in FIG. 1.

The means for returning the relatively clean water from adjacent the surface of the second body of water 14 to the first body of water 12 may in some installations be located a considerable distance away from power source PS. This water return means is as follows.

Figure 5:
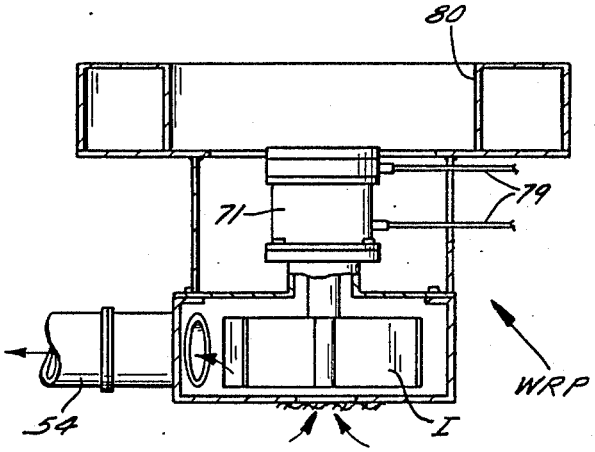
FIG. 5 is a cross-sectional view of the floating hydraulic submersible pump as shown in FIG. 1 on an enlarged scale.

A water return pump WRP (FIGS. 1 and 5) is provided and has a chamber or buoyant means 80 for floatingly suspending it adjacent the surface 18 of the second body of water 14. This pump WRP is located at the said another portion 18 of the second body of water 14 which is spaced away from portion 17. The pump WRP may be of that type shown in FIG. 6 of U.S. Pat. No. 4,352,251 and includes an impeller I driven by a hydraulic motor 71 (FIG. 5) from a fluid pump 74 which is driven by a power unit 78 located on shore and connected thereto by fluid conduits 79. Power unit 78 also has an internal combustion engine E1 and fluid tank T1 of conventional character. Thus, the floating pump WRP continuously returns relatively clean water via conduit 54 from adjacent the surface 18 of the second body of water and back to the area being dredged, for the purposes described.

FIGS. 6–8

Figure 6:
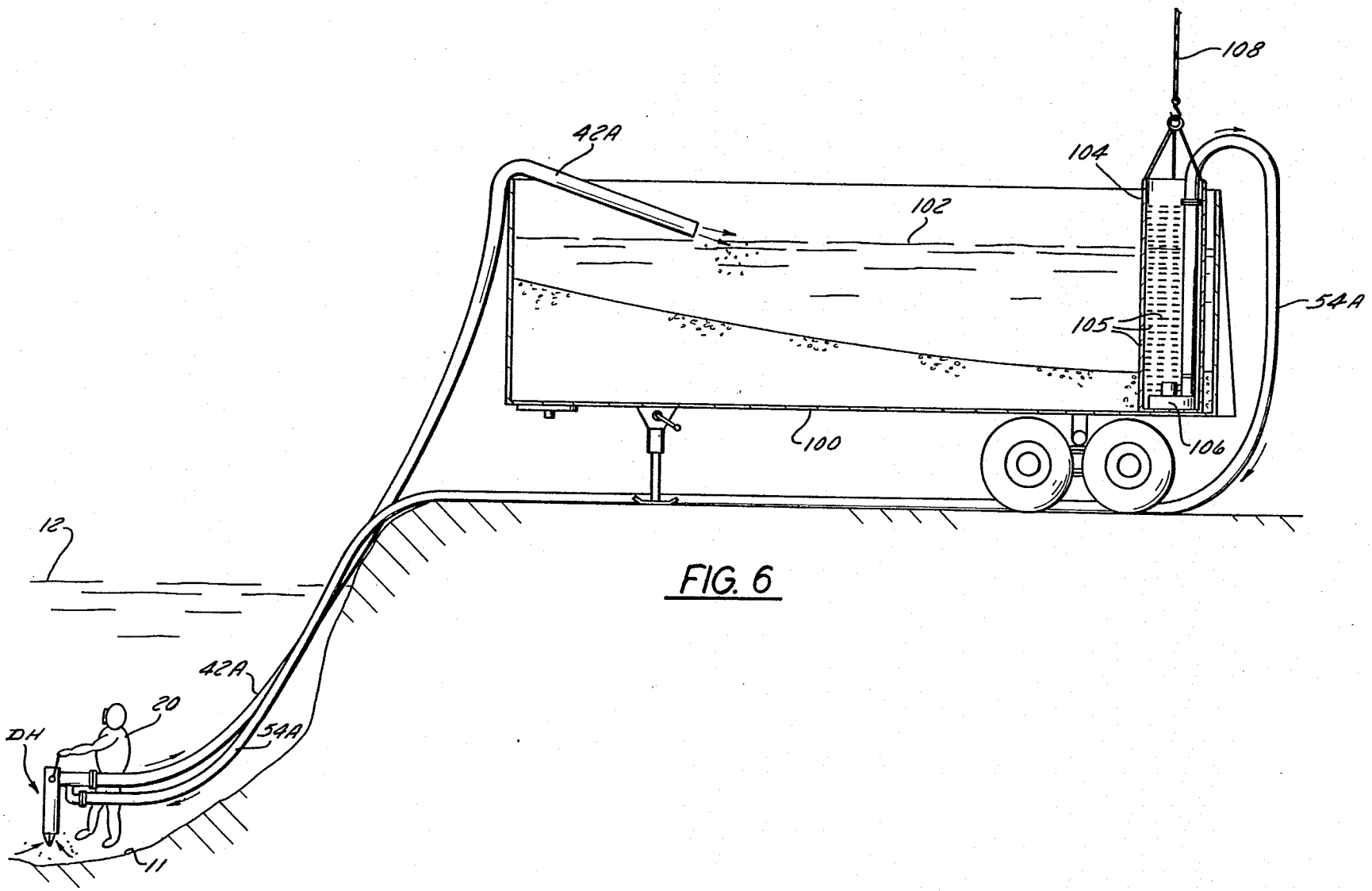
FIG. 6 is another generally schematic, vertical cross-sectional view through the first area being dredged and also showing the solids collecting area as a dump body.

The embodiment of the invention shown in FIG. 6 utilizes a dump body 100 such as a mobile dump body that can be moved by a truck tractor (now shown). In this embodiment the discharge line 42A for the mixture discharges into the dump body where the solids settles out at the bottom of the body. The water level 102 in the truck is such that the slotted pipe 104 or other filter means is located within that body of water. The size of the slots 105 in the cylindrical filter or pipe 104 is preferably about 0.020 of an inch in width which is of a size sufficient to permit rapid passing of water therethrough, but at the same time remove substantially all of the solid material at a rapid rate. These slots can preferably be formed by sawing, the pipe itself preferably being made from the conventional PVC plastic material. The dredge water return line 54A receives the water pumped from the filter 104 by means of the fluid pump 106 located at the bottom of the dump body, for example, and within the filter 104 and thus the return dredge water is pumped back to the dredging area of water, i.e., to a dredge head of the type shown in FIG. 7, thus forming a closed loop circuit for the dredge water. Pump 106 may be of the conventional type known as a trash pump or other submersible hydraulic dredge pump. It should be noted that the filter 104 can be lifted from the dump body by means of a cable 108 and a crane, for example, not shown. The body 100 can then be transported for the dumping of its load of solids elsewhere.

Figure 4:
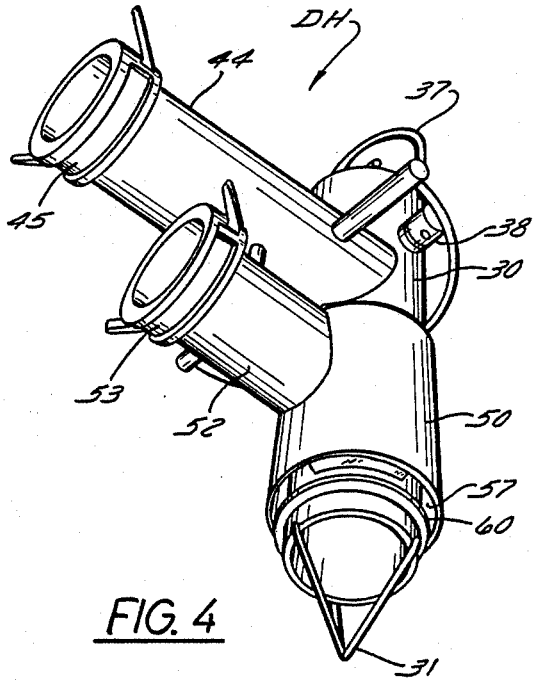
FIG. 4 is a perspective view taken generally from the inlet nozzle end of the dredge head shown in FIG. 3.
Figure 7:
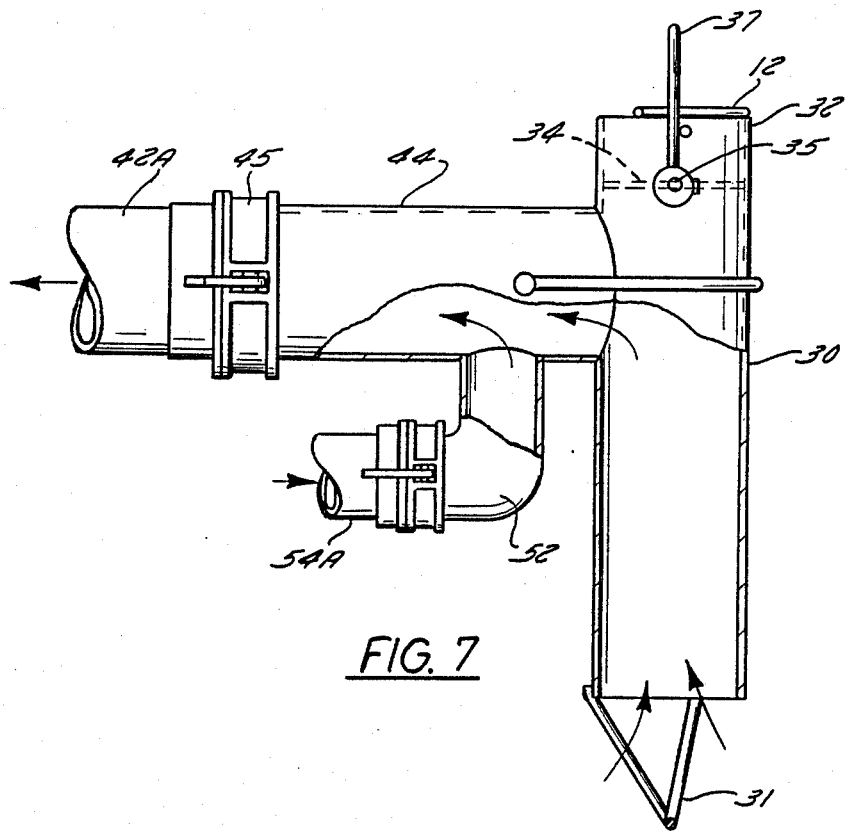
FIG. 7 is a side elevational view, partially in section of another form of dredge head in which the returned dredge water is introduced back into the dredge head to form a fully closed loop system.
Figure 8:
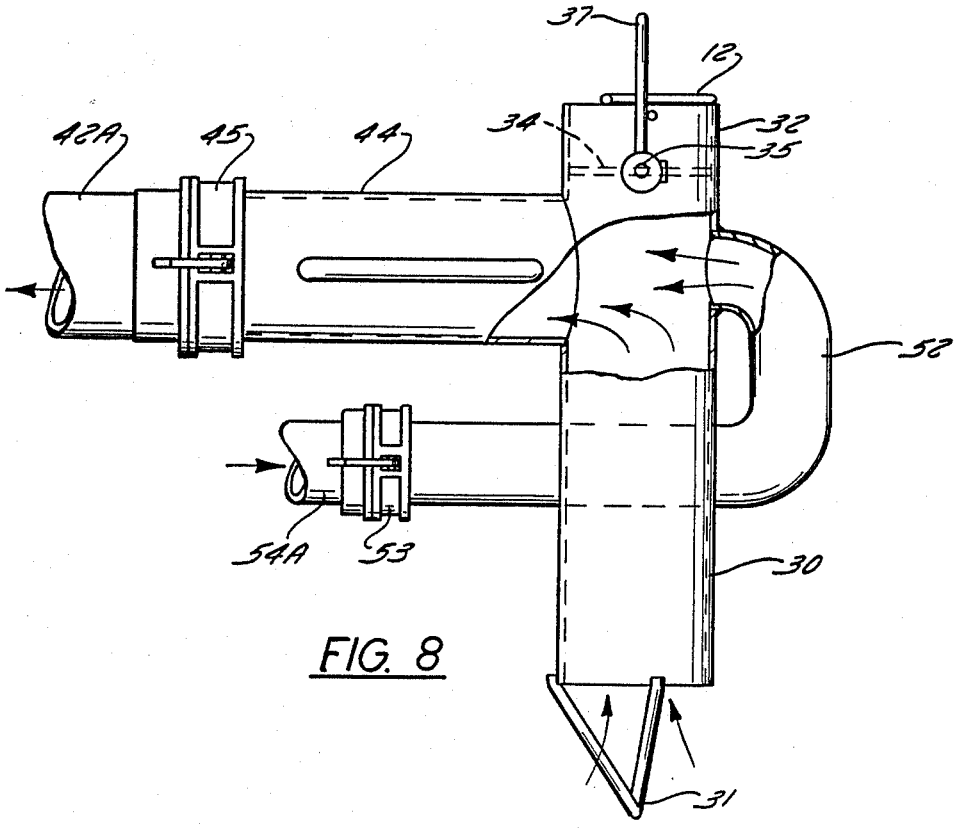
FIG. 8 is a view similar to FIG. 7 but showing a different location on the dredge head for returning the dredge water to the dredge head.

In addition to the common parts of the dredge heads shown in FIGS. 7 and 8 and as previously described in regard to FIGS. 2, 3 and 4, the return dredge water is introduced by the return conduit 54A either directly into the branch 44 of the dredge head (FIG. 7), where it acts to combine with the transporting capabilities of the water sucked in by the nozzle, and thereby is again used to transport the solid material to the solid collecting, second area, in this case, the dump body.

The modification shown in FIG. 8 is similar to that of FIG. 7, but instead the return conduit 54A for the used dredge water is introduced directly into the tubular suction nozzle 30 and is directed towards the branch 44 where its discharge again combines with the solids being sucked up through the nozzle and transports the latter to the second area, whether that area is the second solids collecting body of water 14 or the second solids collecting area shown in the form of the dump body of FIG. 6.

Recapitulation

The above described apparatus for dredging provides a continuously operating system for dredging a mixture of water and solids from a first area and pumping the mixture to a second, solids collecting area. The water used for conveying is continuously reused in the quasi closed or fully closed circuit of the present invention. In the embodiment of the invention shown in FIG. 1, the solids settle out of the mixture and the second body of water and the continuously returning, relatively clean dredge water is either used as a jetting adapter for the dredge nozzle or it can be inserted directly into the dredge nozzle and directed out its discharge for aiding in the conveyance of the solid material. In the embodiment of the invention shown in FIG. 6, the second, solids collecting area takes the form of a truck body into which the solid material is dumped and the dredge water is filtered and thus the relatively clean dredge water is then returned to the first area.

With the present invention, it is possible to continually reuse the same water over and over again to perform the solid conveying function, instead of the necessity for using additional or new dredge water.

We claim:

1. Dredging apparatus forming a dredging loop circuit comprising:

a hand-held dredge head having a suction nozzle for continuously dredging a mixture of solids and water from a first body, of water, a dredge pump and power source located on shore and connected to said dredge head for pumping said mixture from said head and said first body of water and to a second, separate body of water which is spaced a distance from said first body of water and for depositing and allowing the solids to settle out from the mixture at one portion of said second body of water;

a water return pump located adjacent the surface of said second body of water and spaced from said one portion of said second body of water, said water return pump having a return water conduit for returning relatively clear water from adjacent the surface of said second body of water and to the hand held dredge head in said first body of water, whereby the returned dredge water is again used to convey more solids from said first body of water to said second body of water, thereby continually reusing and pumping the dredged water in a loop circuit to convey solids from the first body of water to said second body of water.

2. The apparatus set forth in claim 1 further characterized in that said return water conduit is connected to said hand-held dredge head for discharging water within said dredge head to form a closed loop circuit.

3. The apparatus set forth in claim 1 further characterized by said return water conduit having its discharge adjacent said nozzle to thereby stir up the mixture adjacent said nozzle to facilitate picking up said mixture by said nozzle.

4. The apparatus as described in claim 1 further characterized in that said dredge head comprises a tubular suction nozzle having a lower inlet end and an open upper end for the entry of water therein, a tubular discharge branch extending from said nozzle and at a point intermediate the length of said tubular nozzle, said tubular branch having a discharge end for connection to a suction pipe for conveying excavated material away from said head and to said second, separate body of water, a hand operated valve pivotally mounted in said nozzle adjacent its upper end for permitting the diver operator to move said valve to any adjusted position between a closed position and an open position and for thereby varying the amount of water introduced through said valve and into said nozzle to thereby vary the suction at said lower inlet end of said nozzle, and return water receiving means mounted on said tubular nozzle for receiving returned water from said second body of water and discharging it under pressure adjacent said lower inlet to thereby stir up the material and water adjacent said inlet end of said nozzle.

5. The apparatus set forth in claim 1 characterized in that said hand-held dredge head comprises a tubular suction nozzle having a lower inlet end and an open upper end for the entry of water therein, a tubular discharge branch extending from said nozzle and at a point intermediate the length of said tubular nozzle, said tubular branch having a discharge end for connection to a suction pipe for conveying excavated material away from said head and to said second body of water, swivel coupling means between said discharge end of said branch and said suction pipe whereby said head can be rotationally swivelled relative to said suction pipe and quickly detachably connected thereto, a hand operated valve pivotally mounted in said nozzle adjacent its upper end, an operator's handle secured to said valve and extending from said nozzle for permitting the diver operator to move said valve to any adjusted position between a closed position and an open position and for thereby varying the amount of water introduced through said valve and into said nozzle to thereby vary the suction at said lower inlet end of said nozzle, and a sleeve concentrically mounted on said tubular nozzle and having means for receiving returned water from said second body of water, said sleeve having an open lower end for discharging said returned water under pressure adjacent said lower inlet to thereby stir up the material and water adjacent said inlet end of said nozzle to facilitate its pick-up.

6. Dredging apparatus forming a dredging loop circuit comprising:

a hand-held dredge head having a suction nozzle for continuously dredging a mixture of solids and water from a first body of water, a mobile dump body forming a solids-collecting area, said body having a removable filter tank therein, said tank formed by an upstanding pipe having a series of slots cut therein to act as a filter for permitting substantially only water to pass into said filter, a submergible hydraulic dredge pump located in said filter tank and having a discharge conduit connected thereto and extending to said hand-held dredge for pumping relatively clear water from said filter tank and back to the interior of said dredge head for being reused to convey additional solids picked up by said head to said mobile dump body, and means for lifting said removable filter tank from said dump body.

7. The apparatus set forth in claim 6 further characterized in that said upstanding pipe is formed of PVC plastic material and said series of slots therein are about 0.020 of an inch in width which permit rapid passing of water therethrough but at the same time removes substantially all of the solid material.

* * * * *